US011694660B1

(12) United States Patent
Kammerer

(10) Patent No.: US 11,694,660 B1
(45) Date of Patent: Jul. 4, 2023

(54) GUITAR NECK JOINT

(71) Applicant: Jon David Kammerer, Hamilton, IL (US)

(72) Inventor: Jon David Kammerer, Hamilton, IL (US)

( * ) Notice: Subject to any disclaimer, the term of this patent is extended or adjusted under 35 U.S.C. 154(b) by 0 days.

(21) Appl. No.: 17/659,487

(22) Filed: Apr. 17, 2022

(51) Int. Cl.
*G10D 3/095* (2020.01)

(52) U.S. Cl.
CPC ..... *G10D 3/095* (2020.02)

(58) Field of Classification Search
CPC ..... G10D 3/095; G10D 3/00
See application file for complete search history.

(56) References Cited

U.S. PATENT DOCUMENTS 7,476,790 B2 * 1/2009 Breedlove ..... G10D 1/08 84/293

* cited by examiner

*Primary Examiner* — Kimberly R Lockett

(57) ABSTRACT

An improved body for a stringed instrument wherein the base of the neck slides into a body pocket and onto a flexible protrusion, both made of the body material. The flexible protrusion is drawn toward the pocket by a fastener thereby clamping the base of the neck to the instrument body. No metal parts attach to the base of the neck. The only metal parts involved are the threaded fastener which draws the flexible protrusion toward the pocket and the threaded insert in the flexible protrusion to which this fastener threads. Most of the clamping assembly is hidden inside the body and neck and is not visible when the body and neck are connected. The neck can be removed and replaced rapidly allowing instrument storage in a smaller space and allowing necks of varying scale lengths, fret configurations, or fretboard radius to be attached to the same instrument.

2 Claims, 2 Drawing Sheets

GUITAR NECK JOINT

CROSS-REFERENCE TO RELATED APPLICATIONS

Not Applicable

FEDERALLY SPONSORED RESEARCH

Not Applicable

JOINT RESEARCH AGREEMENT

Not Applicable

INCORPORATION-BY-REFERENCE OF MATERIAL SUBMITTED ELECTRONICALLY

Not Applicable

BACKGROUND OF THE INVENTION

Field of the Invention

This invention relates to stringed musical instruments and, more particularly, to a new and improved body construction for such instruments.

Prior Art

| Patent Number | Kind Code | U.S. Patents Issue Date | Patentee |
|---|---|---|---|
| 7,375,267 | B2 | 2008 May 20 | Poschelk |

Stringed musical instruments that have removable necks offer several advantages. The instrument can be stored and transported more conveniently. A removable neck joint will not be damaged on a hot day as is possible with a glued neck joint. One instrument with multiple necks would allow the player to change scale length, neck profile, fretboard radius, or to use both fretted and fretless necks for the same bass, for instance.

Changing traditional bolt-on necks is possible but requires time and tools. Various quick release mechanisms for necks have been developed that involve needless complication and the unsightly addition of metal parts to the body and neck. Needed is a simple method of securing the neck to the body of a stringed instrument that allows the neck to be removed from the body in a few seconds.

In U.S. Pat. No. 7,375,267 (2008) Poschelk provides an improvement over the prior art by using a metal clamping system to clamp the neck of the guitar to the body. The neck pivots into the correct position using interlocking metal parts and is then clamped in such a manner that the clamping force is parallel to the plane of the body and neck. Metal parts are connected to the base of the neck and to the body of the guitar to allow clamping.

In contrast to Poschelk, this embodiment of the current invention clamps the neck between two portions of the body material and hides most of the clamping mechanism inside the body and neck where they are not visible when the instrument is assembled. No metal parts are attached to the neck base. The only metal parts attached to the body are the threaded fastener which draws the flexible protrusion toward the pocket and the threaded insert in the flexible protrusion to which this fastener threads Also in contrast to Poschelk, this embodiment of the current invention provides a clamping force that is perpendicular to the plane of the body and neck.

SUMMARY

The above problems and others are at least partially solved and the above purposes and others realized in this new and improved body for a stringed instrument wherein the base of the neck slides into a body pocket and onto a flexible protrusion, both made of the body material. The flexible protrusion is drawn toward the pocket by a fastener thereby clamping the base of the neck to the instrument body. No metal parts attach to the base of the neck. The only metal parts involved are the threaded fastener which draws the flexible protrusion toward the pocket and the threaded insert in the flexible protrusion to which this fastener threads. Most of the clamping assembly is hidden inside the body and neck and is not visible when the body and neck are connected While an embodiment of the present invention may use a bolt to draw the flexible protrusion toward the pocket, the bolt need not be removed to remove or replace the neck. Neither the bolt threads nor the head touch the neck directly. The neck does not surround the bolt. Once the bolt is loosened slightly, the neck can be removed and replaced. The only function of the bolt, or whatever adjustable means is used, in contrast to the prior art, is to draw the flexible protrusion toward the pocket.

Further objects and advantages of this embodiment of the invention will become apparent from a consideration of the drawings and ensuing description.

BRIEF DESCRIPTION OF THE SEVERAL VIEWS OF THE DRAWINGS

Referring to the drawings.

DRAWINGS

Reference Numerals

Figure 1:
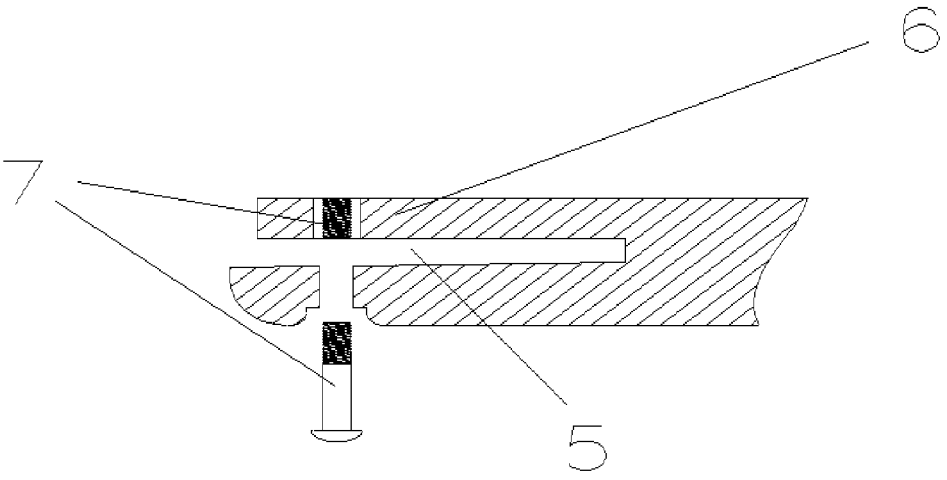
FIG. 1 is a side cutaway view of the top of the body showing the flexible protrusion, pocket, and threaded connector/insert combination.

1. body
2. neck
3. neck base
4. slot
5. body pocket
6. flexible protrusion
7. threaded connector with threaded insert

DETAILED DESCRIPTION OF THE INVENTION

Figure 2:
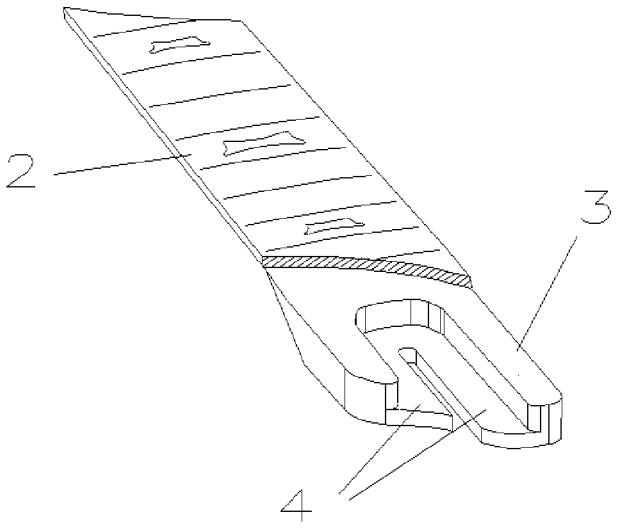
FIG. 2 is a front isometric view showing the base of the neck and the slot.
Figure 3:
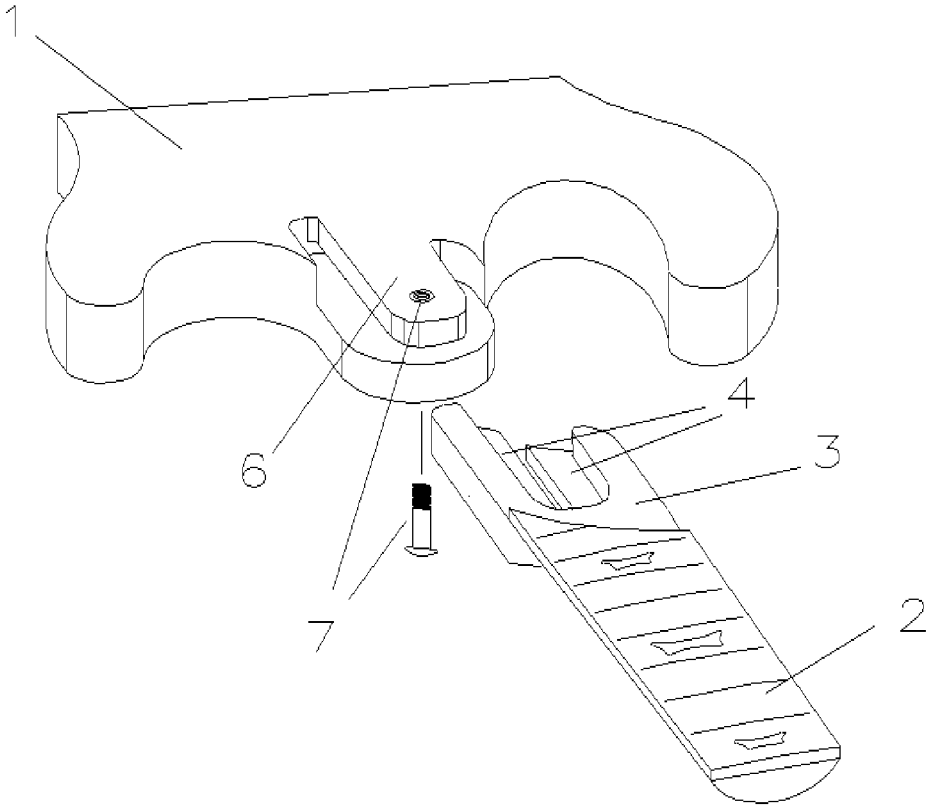
FIG. 3 is a front view of the flexible protrusion showing the location of the threaded insert.

In its preferred embodiment the present body is illustrated in FIGS. 1 to 3 as applied to a guitar body wherein a threaded fastener is used; it should be readily apparent, however, that in other embodiments the clamping means could use a cam or a lever.

In its preferred embodiment the present body is illustrated in FIGS. 1 to 3 as applied to a guitar body made of wood with a neck made of wood; it should be readily apparent, however, that in other embodiments the body and neck could be made of plastic or carbon fiber or metal or any other material that can be formed into the requisite shapes.

In its preferred embodiment the present body is illustrated in FIGS. 1 to 3 as applied to a guitar body wherein the mating surfaces of the neck base, flexible protrusion, and body pocket are smooth; it should be readily apparent, however, that in other embodiments these mating surfaces could have corresponding projections and depressions which interlock when clamping force is applied.

FIGS. 1 to 3 show a stringed instrument body comprising a body 1 having a body pocket 5 opposed by a flexible protrusion 6. The body pocket 5 and flexible protrusion 6 are connected by a threaded connector 7. The neck 2 has a base 3 which contains a slot 4 to receive the flexible protrusion 6. The slot 4 also allows the neck base 3 to fully seat between body pocket 5 and flexible protrusion 6 without hitting threaded connector 7.

Operation of Preferred Embodiment

Threaded connector 7 connects body pocket 5 and flexible protrusion 6. Threaded connector 7 is loosened slightly thereby allowing slot 4 in neck base 3 to receive flexible protrusion 6 while neck base 3 is being fully seated in body pocket 5. Slot 4 in neck base 3 also allows neck base 3 to be fully seated in body pocket 5 while avoiding threaded connector 7. Once neck base 3 is fully seated in body pocket 5, threaded connector 7 is tightened thereby reducing the distance between flexible protrusion 6 and body pocket 5 which clamps neck base 3 between flexible protrusion 6 and body pocket 5.

Threaded connector 7 is loosened slightly thereby increasing the distance between body pocket 5 and flexible protrusion 6. Neck base 3 can then be withdrawn from between body pocket 5 and flexible protrusion 6 thus causing flexible protrusion 6 to be withdrawn from slot 4 in neck base 3.

While there is shown and described the present embodiment of the invention, it is to be distinctly understood that this invention is not limited thereto but may be variously embodied to practice within the scope of the following claims.

I claim:

1. A stringed instrument body, comprising: a body; a neck; said body having a pocket; said body having a flexible protrusion which opposes said pocket; an adjustable length means of connection between said flexible protrusion and said pocket; said neck having a base shaped to fit into said pocket; said base of said neck having a slot to receive said flexible protrusion of said body; said base of said neck having a slot which passes around said adjustable length means of connection between said flexible protrusion and said pocket; whereby said base of said neck is secured between said flexible protrusion of said body and said pocket of said body and is removable and replaceable while said adjustable length means of connection remains connected to said flexible protrusion of said body and said pocket of said body.

2. The stringed instrument of claim 1 wherein the instrument is a guitar and the body and neck are made of wood.

* * * * *